United States Patent [19]

Laughlin

[11] 3,964,640

[45] June 22, 1976

[54] CAN SPOUT

[76] Inventor: Loran L. Laughlin, 701 Deseret Bldg., Salt Lake City, Utah 84111

[22] Filed: Mar. 14, 1975

[21] Appl. No.: 558,465

[52] U.S. Cl. ..... 222/81

[51] Int. Cl.[2] ..... B67B 7/24

[58] Field of Search ..... 222/81, 83, 85, 89, 222/83.5, 88

[56] References Cited

UNITED STATES PATENTS

| | | | |
|---|---|---|---|
| 2,122,540 | 7/1938 | Sedwick et al. | 222/89 X |
| 2,587,716 | 3/1952 | Fengler | 222/81 X |
| 2,784,877 | 3/1957 | Robertson | 222/89 |
| 2,796,199 | 6/1957 | Bigos | 222/81 |
| 3,002,657 | 10/1961 | Liljemark | 222/89 |

*Primary Examiner*—Allen N. Knowles
*Assistant Examiner*—Hadd Lane
*Attorney, Agent, or Firm*—B. Deon Criddle

[57] ABSTRACT

A spout particularly adapted for the pouring of ground coffee from coffee cans and for sealing the coffee can after pouring. The spout is formed of three blanks of metal, stamped into configuration and then rolled or drawn into a finished shape before assembly. A first blank is used to form a spout body, a second blank forms a cutter and a third blank forms a cap. When assembled, the cutter is locked into the body and a flange on the body seals the opening formed by the cutter when the spout is inserted into a coffee can, or the like.

1 Claim, 6 Drawing Figures

CAN SPOUT

BRIEF DESCRIPTION OF THE INVENTION

1. Field of the Invention

This invention relates to a spout adapted to be inserted into a can of ground coffee or the like to allow for easy dispensing of the contents of the can, while preventing loss or change of flavor, moisture content, or other factors from the material within the can when the spout is not being used.

2. Prior Art

It has long been common to use spouts that can be inserted through the tops of cans and the like for the dispensing of the materials from the cans. Such spouts are frequently used with oil cans, for example to pour the contents from the cans into an automobile engine. Sofar as I am aware, however, there has not heretofore been developed a spout that is economically produced, sturdy, and that will effectively seal the opening formed as the cutter portion of the spout is inserted through the top of the can.

Principal objects of the present invention are to provide a spout that can be economically produced, that will withstand rigorous use, that will cut an opening through the top of the can and that will roll the cut out portion of the can top to be out of the way of the material within the can as it is dispensed through the spout, and that will effectively seal the opening formed after the cutter is fully inserted through the top of the can.

Principal features of the invention include a body portion of the spout made from a single blank of metal, a cutter portion, also formed from a single blank of metal material and a lid similarly formed from a single blank of material. The body portion is drawn, and bent into a desired finished configuration, the cutter portion is rolled into a desired finished configuration, and the lid portion is drawn in a similar fashion to the body portion.

Other objects and features of the invention will become apparent from the following detailed description, taken together with the accompanying drawings.

THE DRAWINGS

In the drawings:

FIG. 1 is a plan view of the blank from which the body portion of the spout is produced;

FIG. 2, a plan view of the blank from which the cutter portion is produced;

FIG. 3, a perspective view of the lid after it has been drawn from the original blank; FIG. 4, a view of the body portion after it has been partially drawn from the blank shown in FIG. 1;

FIG. 5, a side elevation view of the spout of the invention, together with all of the component parts in assembled condition; and FIG. 6, a rear elevation view of the assembled spout.

DETAILED DESCRIPTION

Figure 1:
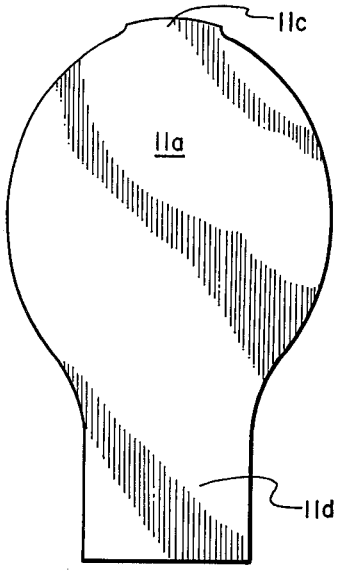

Referring now to the drawings:

In the illustrated preferred embodiment of the invention the spout, shown generally at 10, includes a body portion 11, a cutter portion 12, and a lid or stopper, shown generally at 13.

Figure 2:
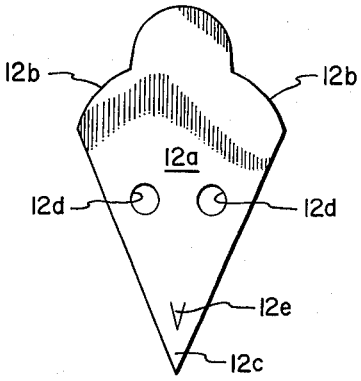
Figure 3:
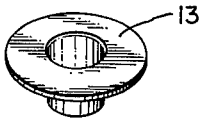
Figure 4:
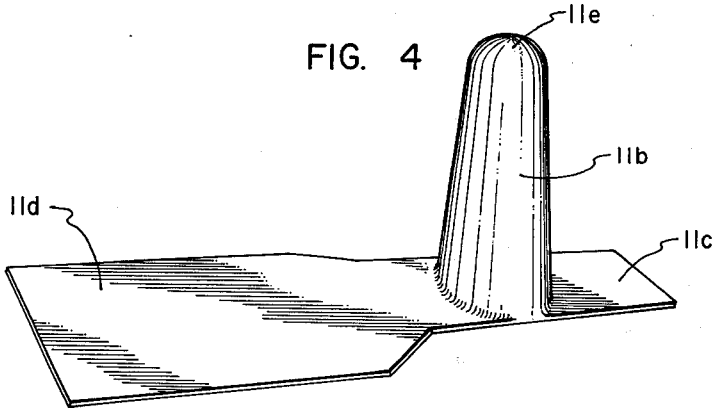
Figure 5:
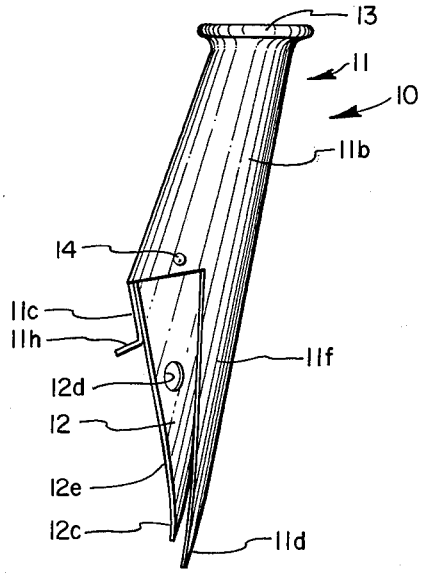
Figure 6:
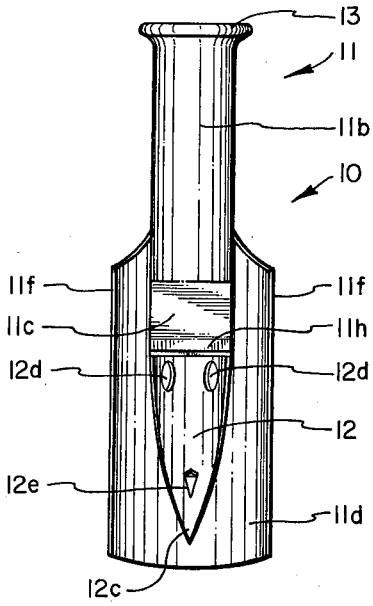

The body portion 11 is formed from a blank 11*a* of metal having the configuration shown in FIG. 1. The metal blank 11*a* is drawn over a series of molds, not shown, until the blank obtains the configuration shown in FIG. 4. In this configuration an upstanding finger 11*b* projects from a tongue 11*c* and a extension 11*d*. Upon further extension and bending, the dome portion 11*e* of the finger 11*b* is opened and the extension 11*d* is bent down to form a can engaging apron (FIGS. 5 & 6) that will engage and conform to the outer wall of the can as the spout is inserted into the can. Outer edges 11*f* of the skirt 11*d* are turned inwardly to provide strength to the skirt. At the same time the upper end of the body portion is flared at 11*g* to provide a rest for the lid or stopper 13. Cutter portion 12 is formed from a blank 12*a*, of steel, having the generally triangular configuration shown in FIG. 2. In shaping the cutter portion the blank 12*a* is rolled on lines extending from the inner portion of shoulders 12*b* to a point 12*c*. Holes 12*d* punched through the blank 12*a* allow material to pass through the cutter portion and into the spout, as will become more apparent hereinafter. A pointed tab 12*e* is punched in the cutter portion and is bent to project inwardly within the curved cutter formed by rolling of the blank 12*a*.

In assembling the spout of the invention the rolled blank 12*a* is inserted into the body portion 11 such that the shoulders 12*b* just fit within the finger 11*b* and the point 12*c* of blank 12*a* extends closely down the skirt 11*d*. Aligned holes are drilled through the finger 11*b* and through the shoulders 12*b* so that a pin 14 can be inserted therethrough. The ends of the pin may be peened to keep the pin from coming out. Thereafter the tongue 11*c* is bent downwardly over the rolled edges of the cutter portion to hold the cutter portion firmly against the skirt 11*d*. A portion 11*h* of the tongue 11*c* is then turned outwardly to form a seal, as will be hereinafter described.

In using the spout of the invention, the skirt 11*d* is pushed down the outside of a can while the cutter 12 is forced through the top and down the inside wall of the can. As the cutter is inserted the pointed tab 12*e* curls the cut out portion of the lid and pushes it away from the spout. The spout is inserted until the portion 11*h* of tab 11*c* engages and rests on top of the can. So positioned, the spout entirely fills the opening except for the part of the opening which is covered by portion 11*h*. When the material in the can is poured through the spout, it may discharge either directly through the finger 11*b* or through the holes 12*d* in the cutter and then through the finger 11*b*.

The lid or stopper 13 fits tightly in the open end of the body portion and allows the spout to be entirely sealed. This makes the spout particularly useful for the discharging of perishable goods, the flavor or quality of which can be sustained by proper sealing of the spout. Therefore, if only a portion of the goods of the material contained in the can is discharged, the lid or stopper 13 can be positioned to seal the spout and, since the opening formed by the spout is entirely sealed either by the spout itself or by the portion 11*h* of the spout, the contents of the can can be rather securely sealed and can be maintained in a quality condition for a longer period of time. While the spout is particularly useful with cans containing ground coffee, since it is important that the ground coffee be kept fresh and not be exposed to atmosphere, it will be apparent that it can be used with many other flowable products, including liquids such as fruit juices, or punch and other fluid solids. It is to be understood that the present disclosure is made by way of example, and that variations are possible without departing from the scope of the hereinafter claimed subject matter, which subject matter I regard as my invention.

I claim:

1. A spout for use with cans containing ground coffee and the like, comprising a body portion formed from a single blank of metal, centrally drawn to have a finger projecting from a flat face of a tongue and a skirt portion, with the ends of said finger being open;

a cutter portion formed from a single blank of metal material of generally triangular configuration, and with shoulders formed at one side thereof, said shoulders being rolled on a line extending from their inner edges towards a point of said blank, holes through the cutter portion between the shoulders and the point, and a pointed projection punched from the cutter portion adjacent the point thereof and extending inwardly of the rolled shoulders; and a pin extending through the finger and said shoulders when said shoulders are inserted into said finger and said tongue is bent downwardly over the cutter portion, to secure said cutter portion within said body portion with the point of the cutter portion extending downwardly and against the skirt portion of the body portion; and a portion of the tongue of the body portion extending substantially normal to and away from the cutter portion to serve as a seal extending over a portion of the opening formed by insertion of the spout into the top of a can when the spout is fully inserted into the can.

* * * * *